US009966690B1

(12) United States Patent
Kan et al.

(10) Patent No.: US 9,966,690 B1
(45) Date of Patent: May 8, 2018

(54) MODULAR ELECTRICAL CONNECTOR

(71) Applicant: KINSUN INDUSTRIES INC., Taoyuan (TW)

(72) Inventors: Ching-Neng Kan, Taoyuan (TW); Li-Ju Hsu, Taoyuan (TW); Shu-Hung Hsiao, Taoyuan (TW)

(73) Assignee: KINSUN INDUSTRIES INC., Taoyuan (TW)

( * ) Notice: Subject to any disclaimer, the term of this patent is extended or adjusted under 35 U.S.C. 154(b) by 0 days. days.

(21) Appl. No.: 15/662,259

(22) Filed: Jul. 27, 2017

(30) Foreign Application Priority Data

Jan. 6, 2017 (TW) ..... 106100408 A

(51) Int. Cl.
*H01R 13/502* (2006.01)
*H01R 13/514* (2006.01)
*H01R 43/18* (2006.01)
*H01R 13/6467* (2011.01)

(52) U.S. Cl.
CPC ..... *H01R 13/514* (2013.01); *H01R 13/6467* (2013.01); *H01R 43/18* (2013.01)

(58) Field of Classification Search
CPC .. H01R 13/514; H01R 13/6467; H01R 43/18; H01R 13/6471; H01R 13/6581
USPC ..... 439/701
See application file for complete search history.

(56) References Cited

U.S. PATENT DOCUMENTS

| | | | | |
|---|---|---|---|---|
| 7,059,769 | B1 * | 6/2006 | Potega | B60L 11/1861 338/22 R |
| 9,590,364 | B1 * | 3/2017 | Chang | H01R 13/6581 |
| 2011/0194823 | A1 * | 8/2011 | Wu | G02B 6/3817 385/92 |
| 2016/0043508 | A1 * | 2/2016 | Helster | H01R 13/6467 439/607.07 |
| 2017/0018881 | A1 * | 1/2017 | Patel | H01R 13/6471 |

* cited by examiner

*Primary Examiner* — Jean F Duverne

(57) ABSTRACT

A modular electrical connector having the characteristics of simple manufacturing process, reduced manufacturing cost and high production yield is disclosed to include two signal terminal sets arranged one above the other in a staggered manner to provide a compensated structure, and an electrically insulative terminal block including a mounting block and a mating connection block and molded on the signal terminal sets by injection molding. The connection segments of the signal terminals of the two signal terminal sets are bent to move the mounting block and the mating connection block toward each other to further force a positioning portion of the mounting block into engagement with a positioning groove of the mating connection block.

6 Claims, 13 Drawing Sheets

A-A

MODULAR ELECTRICAL CONNECTOR

BACKGROUND OF THE INVENTION

1. Field of the Invention

The present invention relates to electrical connector technology and more particularly, to a modular electrical connector having the characteristics of simple manufacturing process, reduced manufacturing cost and high production yield, which comprises two signal terminal sets arranged one above the other in a staggered manner to provide a compensated structure, and an electrically insulative terminal block including a mounting block and a mating connection block and molded on the signal terminal sets by injection molding, wherein the connection segments of the signal terminals of the two signal terminal sets are bent to move the mounting block and the mating connection block toward each other to further force a positioning portion of the mounting block into engagement with a positioning groove of the mating connection block.

2. Description of the Related Art

An electrical connector for signal transmission generally comprises an electrically insulative terminal block, and a plurality of signal terminals embedded in the electrically insulative terminal block and arranged in parallel. In order to avoid crosstalk, a compensated structure is created. This compensated structure allows each two adjacent signal terminals to be partially extended over each other without contact so as to form a capacitive effect for reducing crosstalk interference. However, because each two adjacent terminals are overlapped in the vertical projection profile, the mounting of the signal terminals in the electrically insulative terminal block is complicated, bringing trouble. For easy installation of the signal terminals in the electrically insulative terminal block, the electrically insulative terminal block is configured to provide an open space on the inside and a plurality of positioning holes at each of two opposite sides thereof. In installation, the signal terminals are mounted in the open space inside the electrically insulative terminal block with the two opposite ends thereof respectively positioned in the respective positioning holes. This mounting arrangement is complicated, lowering the production yield. Further, as the electronic products continue to miniaturize, it makes the assembly process of the signal terminals and the electrically insulative terminal block more difficult.

SUMMARY OF THE INVENTION

The present invention has been accomplished under the circumstances in view. It is therefore the main object of the present invention to provide a modular electrical connector having the characteristics of simple manufacturing process, reduced manufacturing cost and high production yield, which comprises two signal terminal sets arranged one above the other in a staggered manner to provide a compensated structure, and an electrically insulative terminal block including a mounting block and a mating connection block and molded on the signal terminal sets by injection molding, wherein the connection segments of the signal terminals of the two signal terminal sets are bent to move the mounting block and the mating connection block toward each other to further force a positioning portion of the mounting block into engagement with a positioning groove of the mating connection block.

To achieve this and other objects of the present invention, a modular electrical connector comprises two signal terminal sets and an electrically insulative terminal block. The two signal terminal sets are vertically arranged adjacent to each other. Each signal terminal set comprises a plurality of signal terminals arranged in parallel. Each signal terminal comprises a signal output segment, an opposing signal input segment, a connection segment connected between the signal output segment and the signal input segment, and a first compensation segment connected between the connection segment and the signal output segment. The first compensation segments of the signal terminals of the two signal terminal sets are reversely curved to form a staggered compensated structure. The electrically insulative terminal block comprises a mounting block and a mating connection block, and is molded on the two signal terminal sets by injection molding. The mounting block is wrapped about the first compensation segments of the signal terminals of the two signal terminal sets. The mating connection block is partially wrapped about the signal input segments and connection segments of the signal terminals of the two signal terminal sets. The mounting block comprises a body, and a positioning portion located at one side of the body. The mating connection block comprises a base, and a positioning groove located on one side of the base. The connection segments of the signal terminals of the two signal terminal sets are bent to move the mounting block and the mating connection block toward each other to further force the positioning portion of the mounting block into engagement with the positioning groove of the mating connection block.

DETAILED DESCRIPTION OF THE PREFERRED EMBODIMENT

Figure 1:
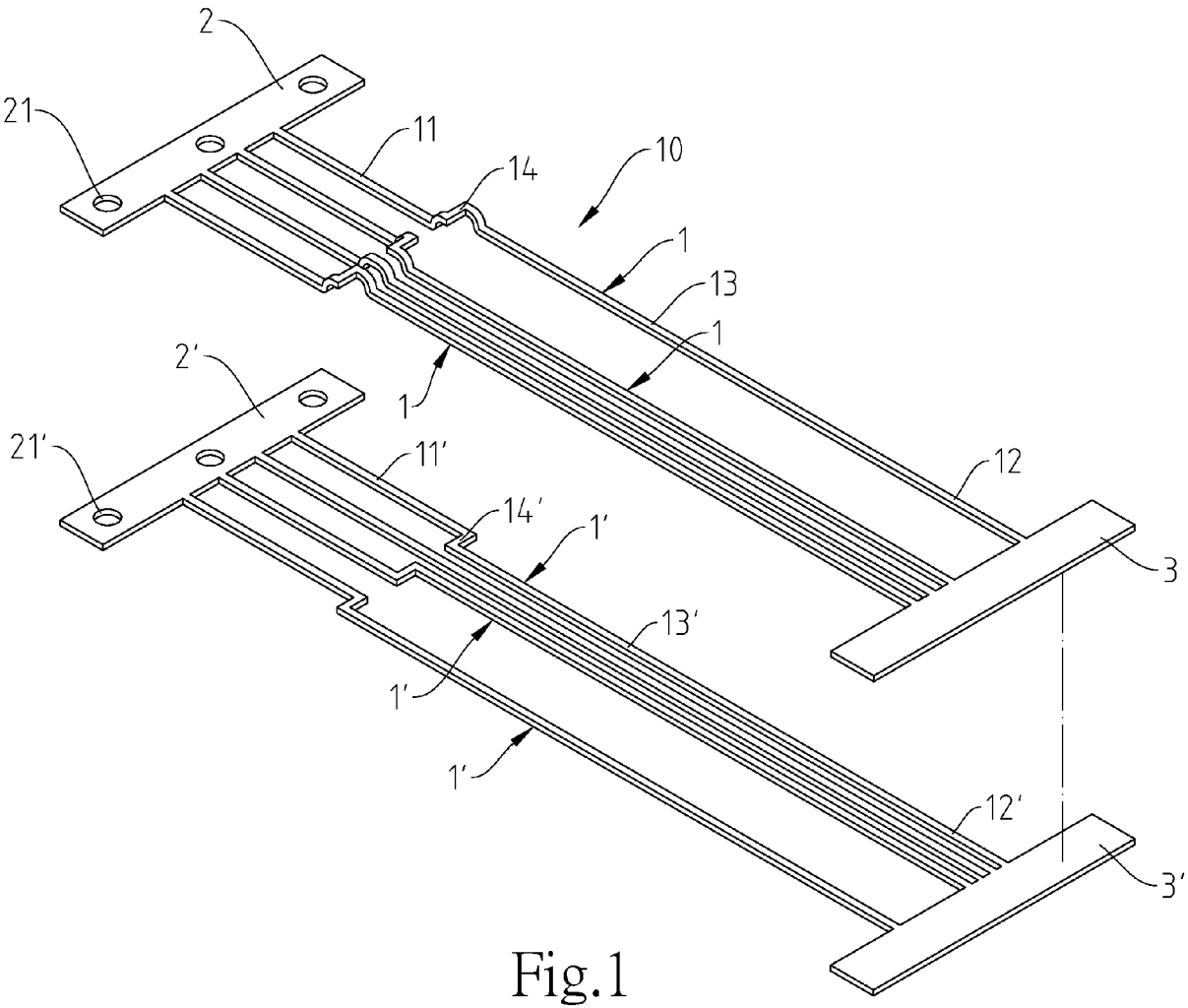
FIG. 1 is an exploded view of a part of a modular electrical connector in accordance with the present invention, illustrating the configuration of two signal terminal sets.
Figure 2:
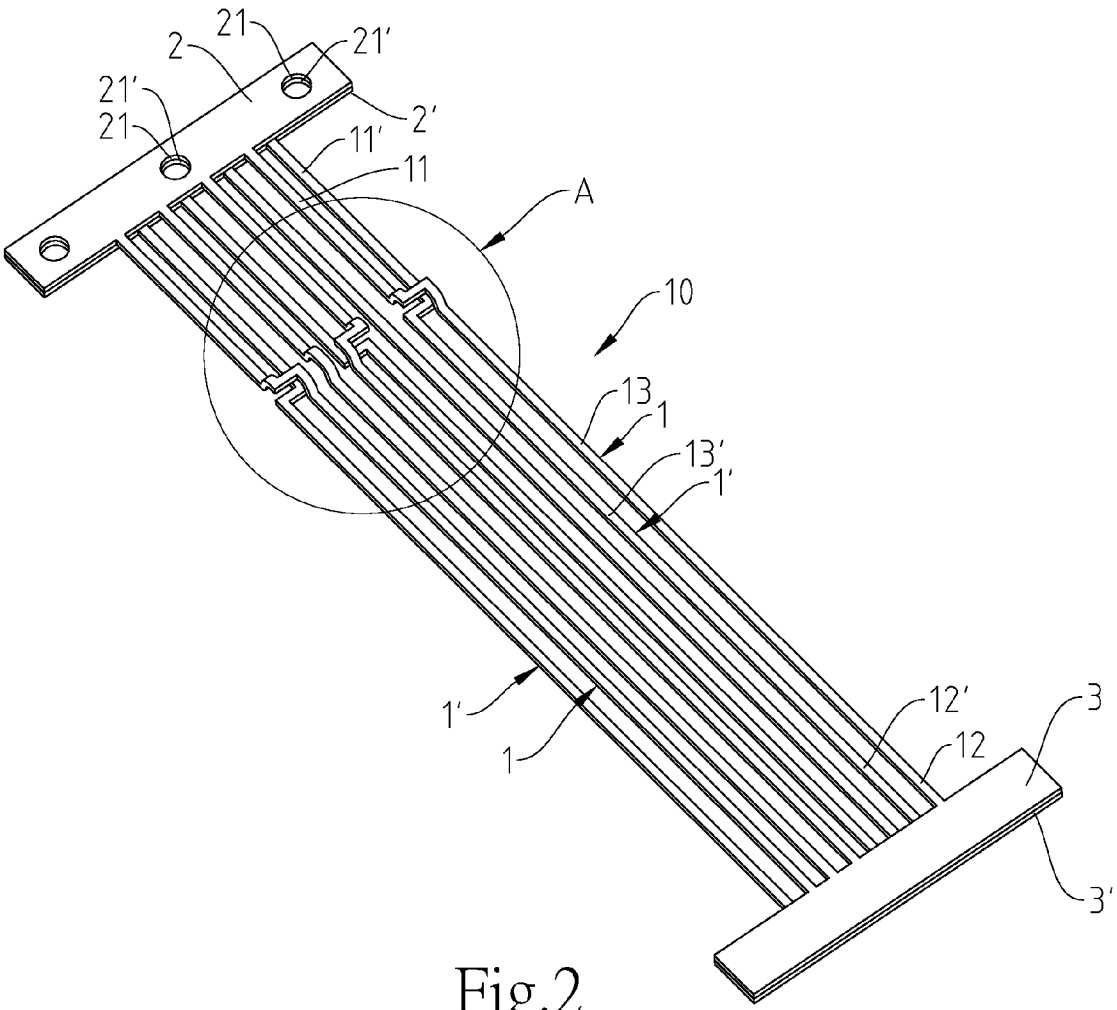
FIG. 2 is an oblique top elevational view of a part of the present invention, illustrating the two signal terminal sets arranged in a stack.
Figure 3:
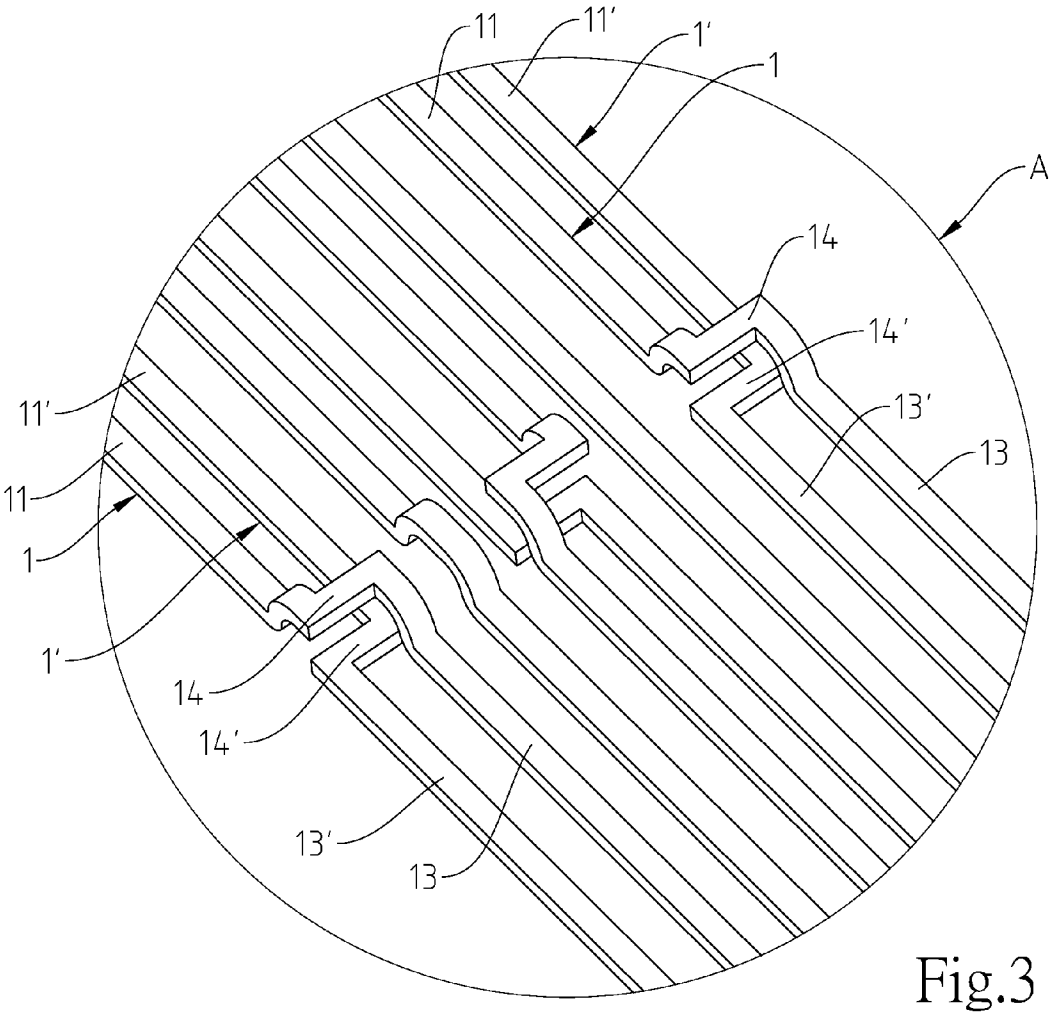
FIG. 3 is an enlarged view of Part A of FIG. 2.
Figure 4:
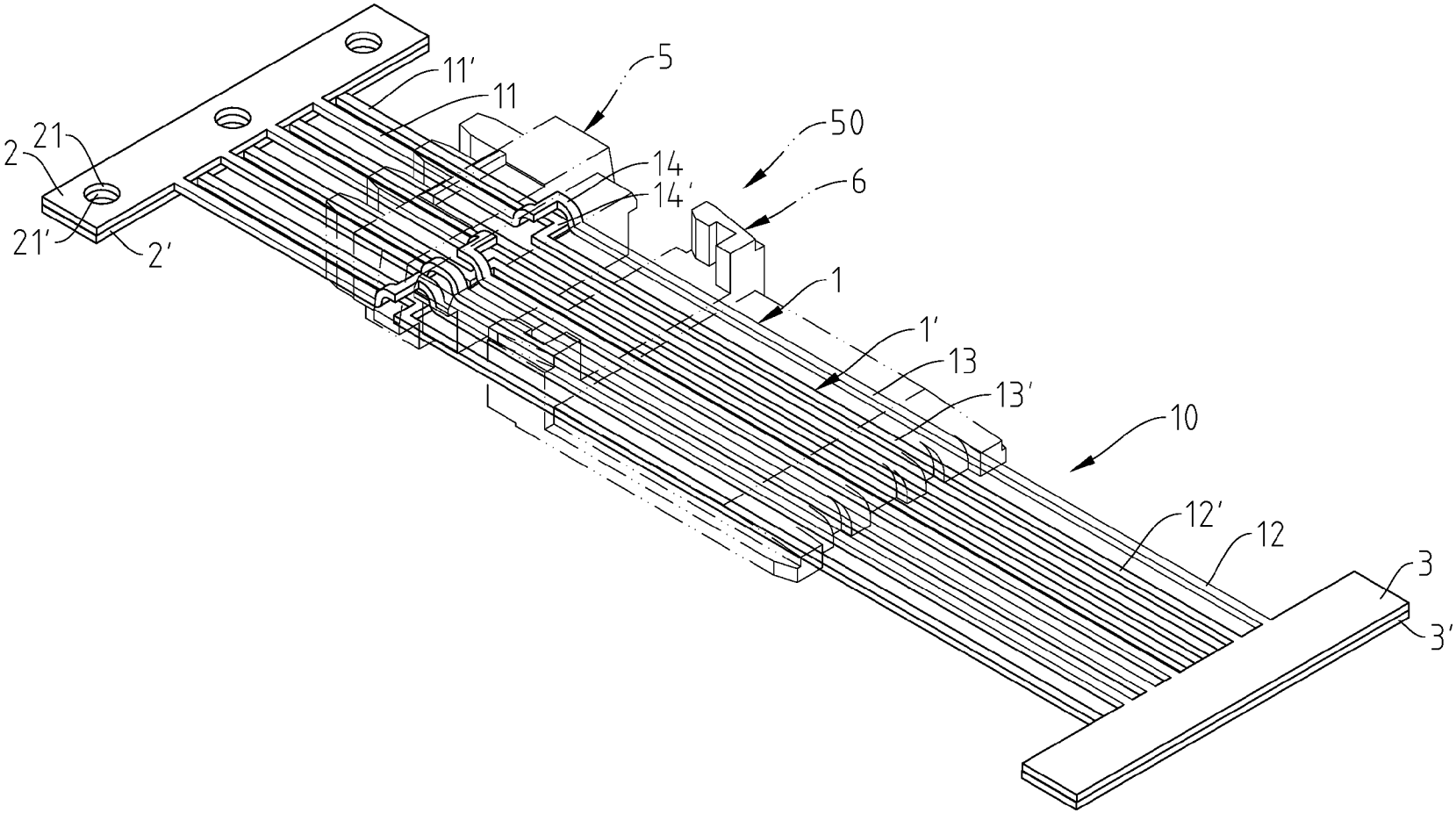
FIG. 4 is a schematic drawing of the present invention, illustrating the electrically insulative terminal block molded on the signal terminal sets.
Figure 5:
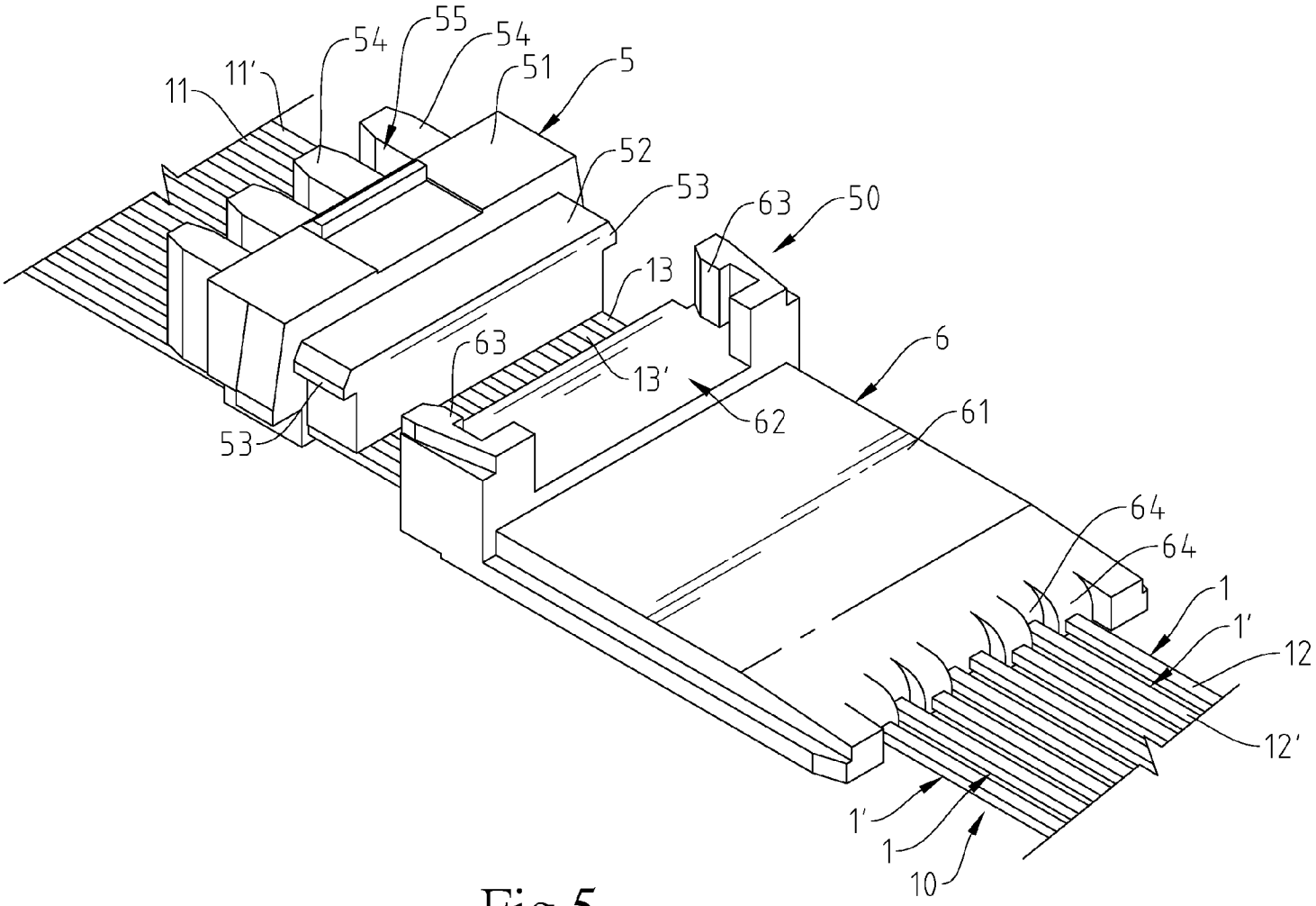
FIG. 5 is an oblique top elevational view of the present invention illustrating the electrically insulative terminal block molded on the signal terminal sets before bending of the signal terminals of the signal terminal sets.
Figure 6:
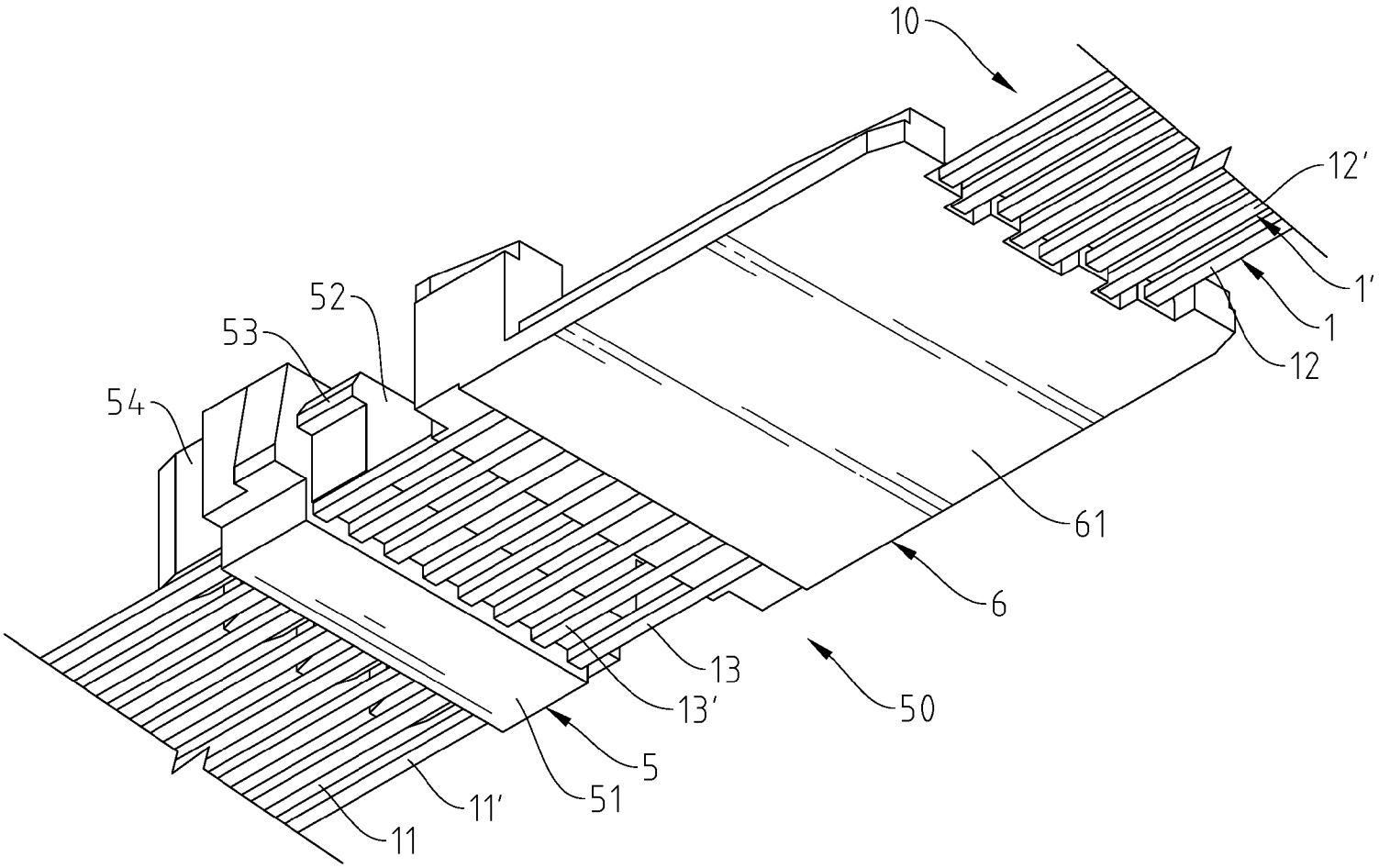
FIG. 6 corresponds to FIG. 5 when viewed from another angle.
Figure 7:
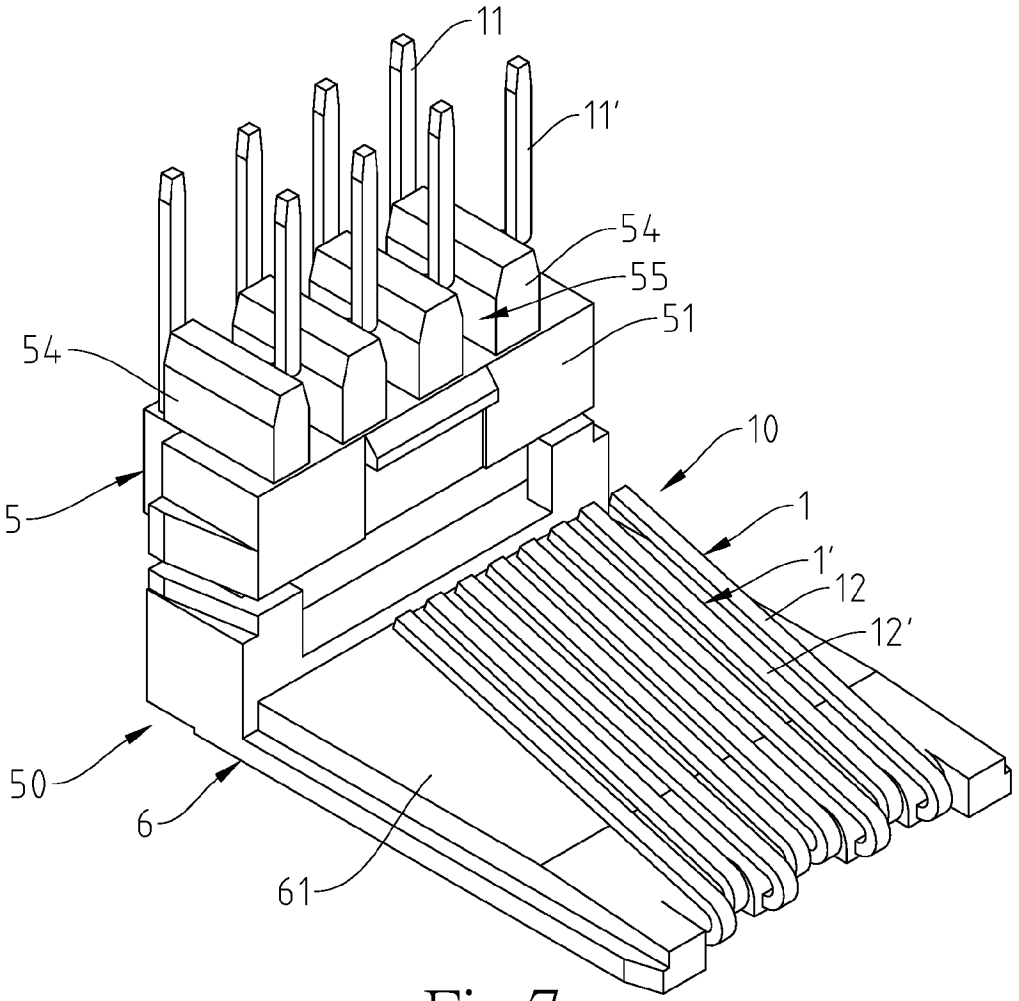
FIG. 7 is an oblique top elevational view of the modular electrical connector in accordance with the present invention.
Figure 8:
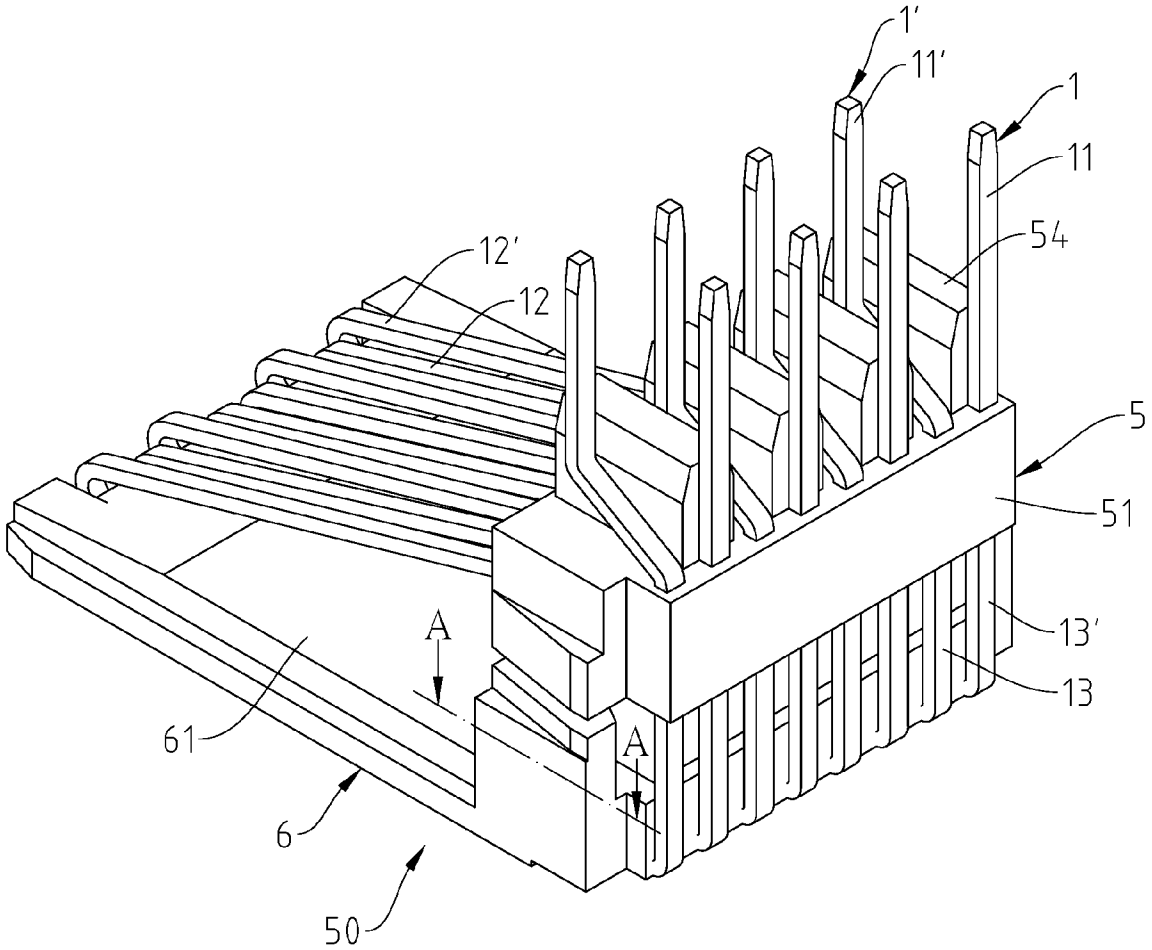
FIG. 8 corresponds to FIG. 7 when viewed from another angle.
Figure 9:
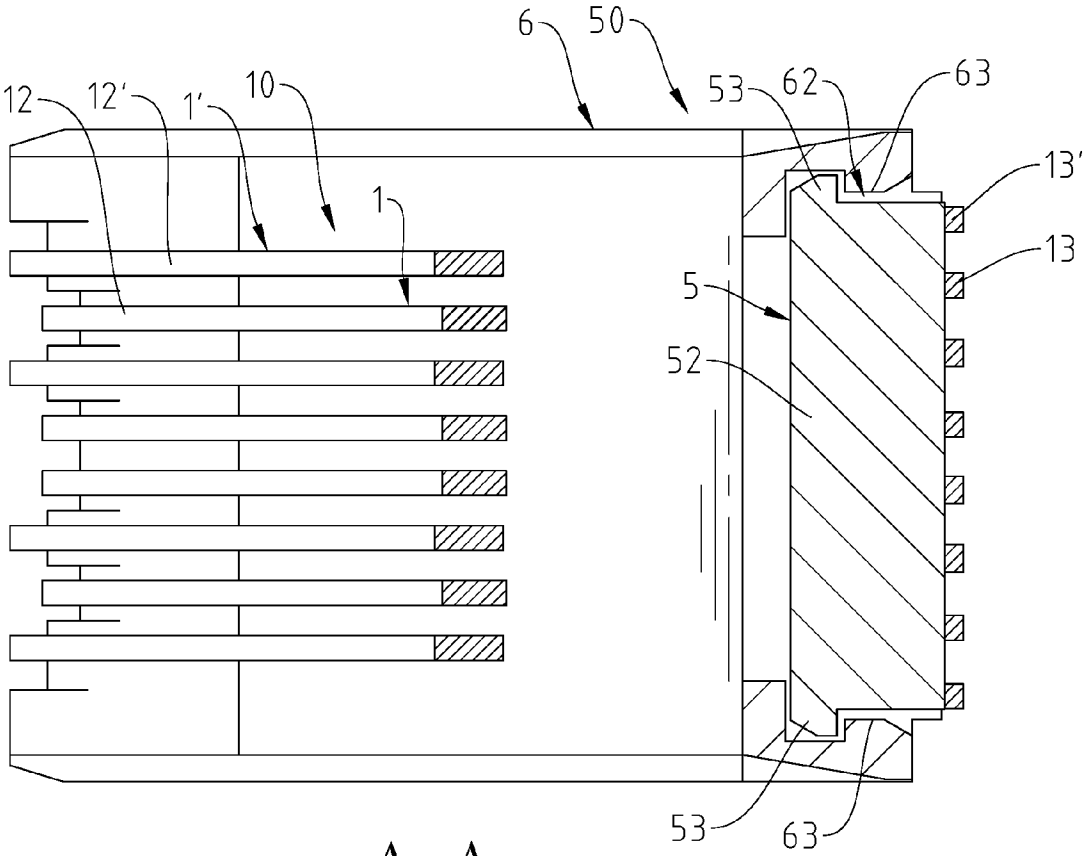
FIG. 9 is a sectional view taken along line A-A of FIG. 8.
Figure 10:
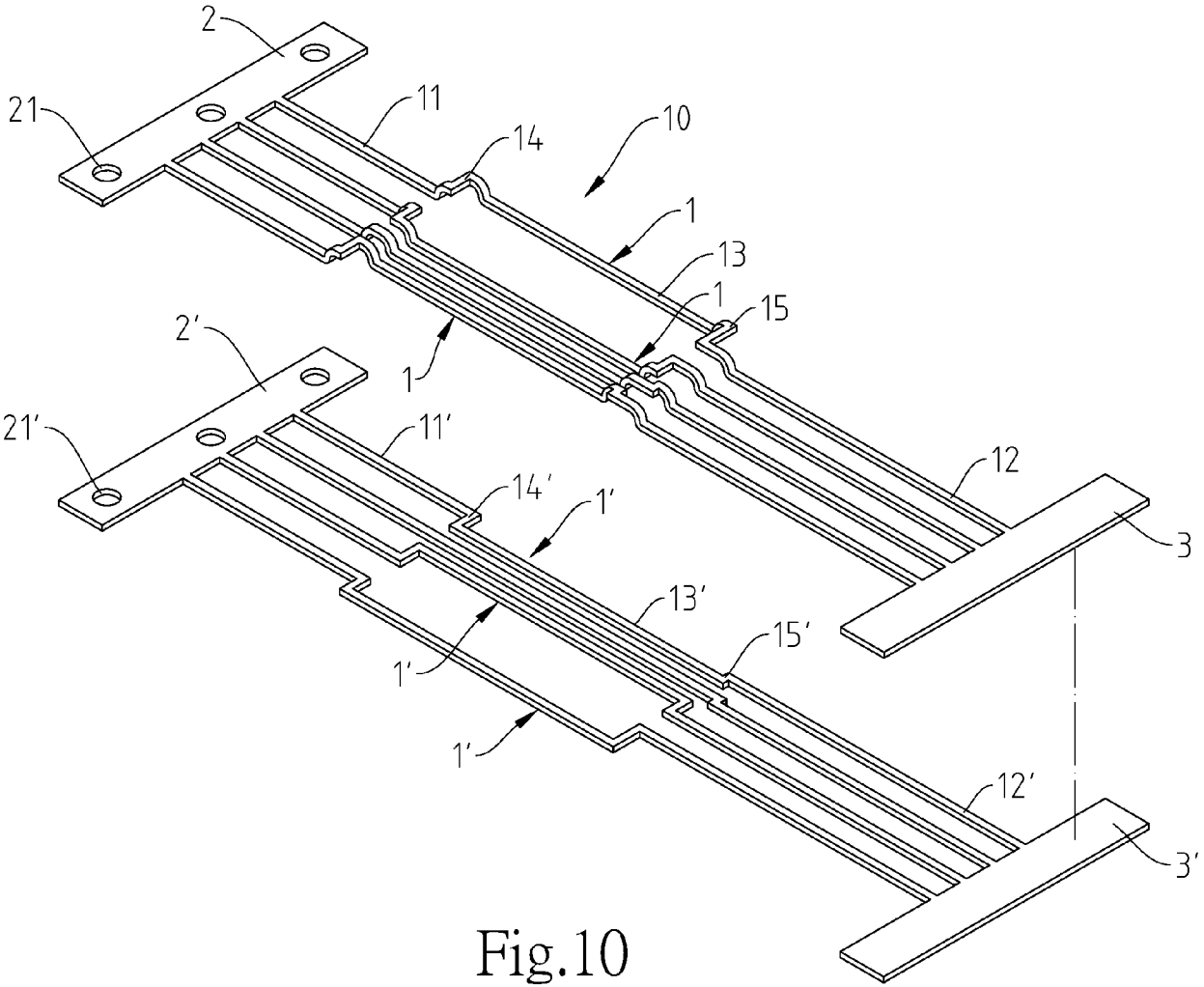
FIG. 10 is an exploded view of a part of an alternate form of the modular electrical connector in accordance with the present invention, illustrating the configuration of the two signal terminal sets.
Figure 11:
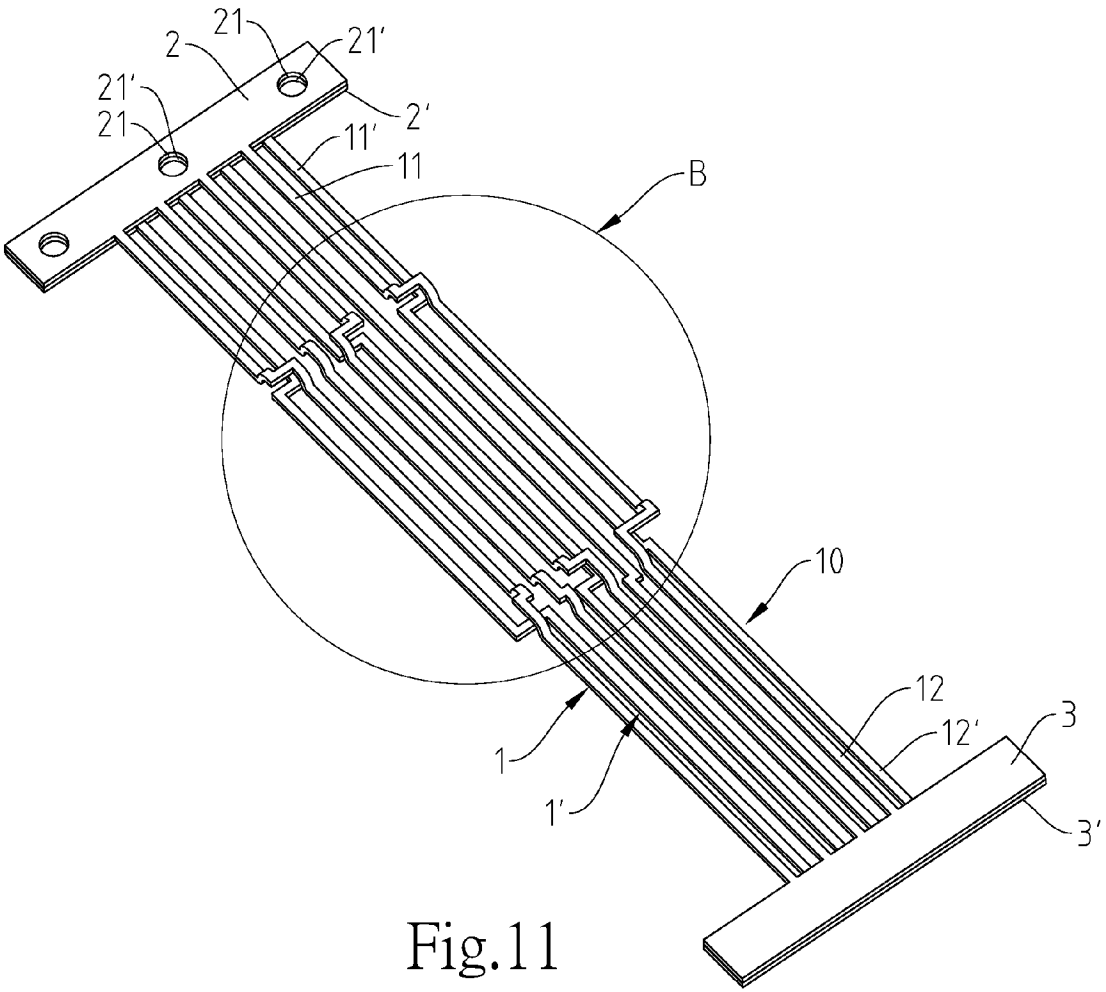
FIG. 11 is an oblique top elevational view of a part of the alternate form of the present invention, illustrating the two signal terminal sets arranged in a stack.
Figure 12:
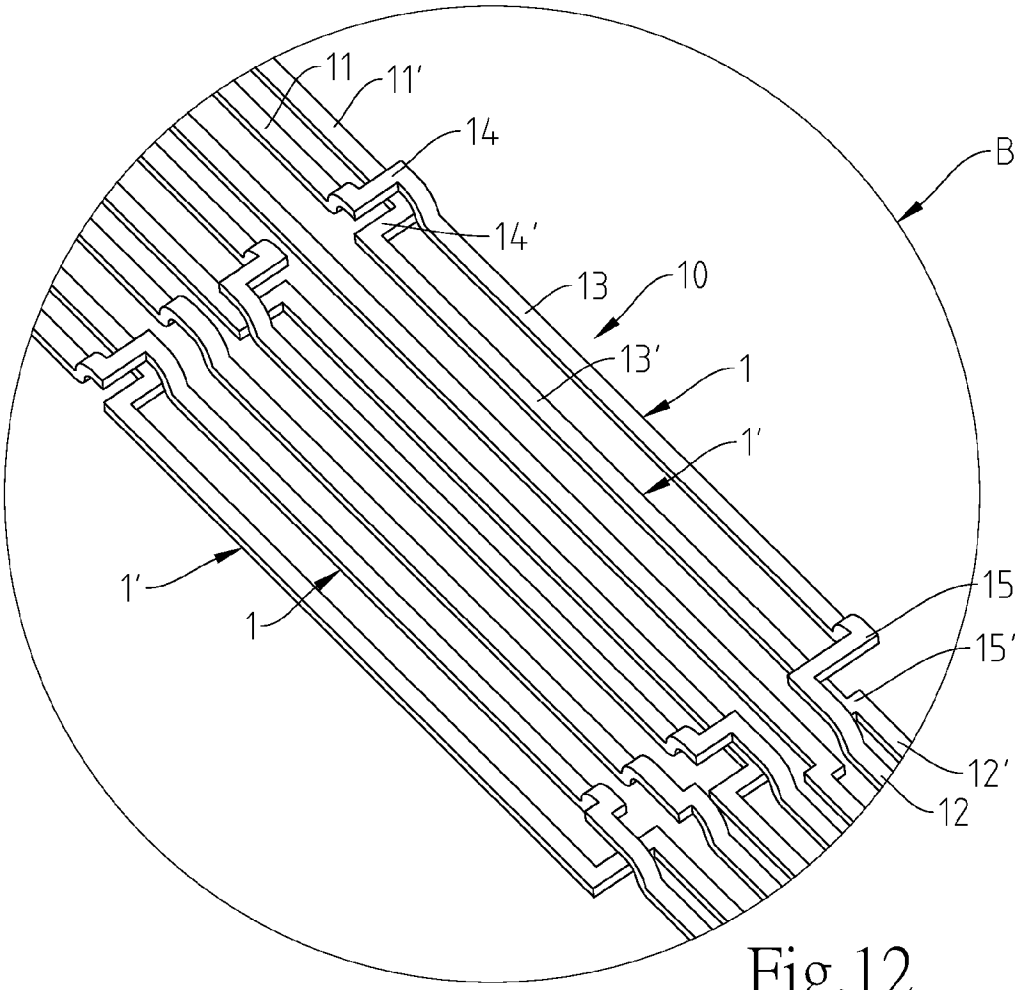
FIG. 12 is an enlarged view of Part B of FIG. 11.
Figure 13:
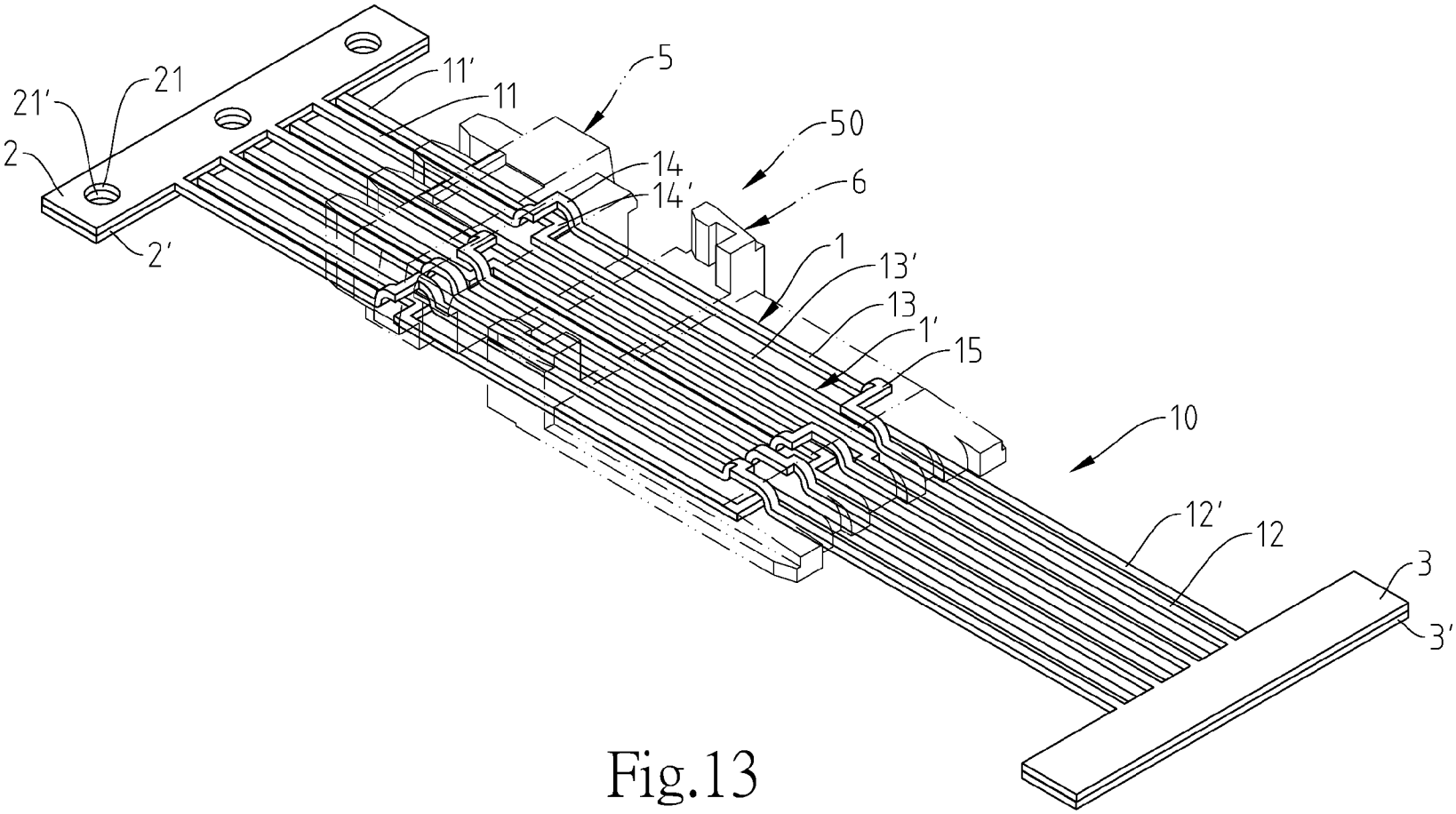
FIG. 13 is a schematic drawing of the alternate form of the present invention, illustrating the electrically insulative terminal block molded on the signal terminal sets.

Referring to FIGS. 1-3, a modular electrical connector in accordance with the present invention comprises two signal terminal sets (10). Each signal terminal set (10) comprises a plurality of signal terminals (1,1') arranged in parallel. Each signal terminal (1,1') comprises a signal output segment (11,11'), an opposing signal input segment (12,12'), a connection segment (13,13') connected between the signal output segment (11,11') and the signal input segment (12,12'), and a first compensation segment (14,14') connected between the connection segment (13,13') and the signal output segment (11,11'). The first compensation segments (14,14') of each two adjacent signal terminals (1,1') are reversely curved, forming a compensated structure where the first compensation segments (14,14') are staggered and not in contact with each other. Each signal terminal set (10) further comprises a first material strip (2,2') and a second material strip (3,3') respectively and transversely arranged at two opposite sides in a parallel manner and respectively connected with the signal output segments (11,11') and signal input segments (12,12') of the signal terminals (1,1'). The first material strips (2,2') of the signal terminal sets (10) each comprise a plurality of positioning holes (21,21') spaced along the length thereof. When the two signal terminal sets (10) are arranged in a stack, the positioning holes (21) of the first material strip (2) of one signal terminal set (10) are respectively aligned with the positioning holes (21') of the first material strip (2') of the other signal terminal set (10) where the first compensation segments (14,14') of the signal terminals (1,1') form a compensated structure.

Referring to FIGS. 4-7, after the signal terminal sets (10) are arranged in a stack, the stack of the two signal terminal sets (10) is put in an injection molding machine (not shown), and then the injection molding machine is operated to mold an electrically insulative terminal block (50). The electrically insulative terminal block (50) comprises a mounting block (5) and a mating connection block (6). The mounting block (5) is wrapped about the first compensation segments (14,14') of the signal terminal sets (10). The mating connection block (6) is partially wrapped about the signal input segments (12,12') and connection segments (13,13') of the signal terminal sets (10). Since the first compensation segments (14,14') are embedded in the mounting block (5), the first compensation segments (14,14') are protected against deformation in the subsequent assembly process. The mounting block (5) comprises a body (51), a positioning portion (52) located at one side of the body (51), two engagement ribs (53) respectively protruded from two opposite lateral sides of the positioning portion (52), a plurality of abutment ribs (54) located at an opposite side of the body (51) remote from the positioning portion (52), and a bending space (55) defined by the abutment rib (54). The mating connection block (6) comprises a base (61), a positioning groove (62) located on one side of the base (61), two upright stop ribs (63) respectively located at two opposite lateral sides of the positioning groove (62), and a staggered abutment surface portion (64) located on an opposite side of the base (61) remote from the positioning groove (62).

Referring to FIGS. 5-9, when assembling the mounting block (5) and the mating connection block (6), bend the connection segments (13,13') of the signal terminal sets (10) to move the mounting block (5) and the mating connection block (6) toward each other and to further force the positioning portion (52) of the mounting block (5) into the positioning groove (62) of the mating connection block (6). At this time, the engagement ribs (53) are respectively forced into engagement with the respective upright stop rib (63), and thus, the mounting block (5) and the mating connection block (6) are assembled. After installation of the electrically insulative terminal block (50), the signal output segments (11,11') of the signal terminal sets (10) are positioned in the bending space (55) in two rows and abutted at the respective abutment ribs (54), facilitating further circuit board bonding (not shown); the signal input segments (12, 12') of the signal terminal sets (10) are abutted at the staggered abutment surface portion (64) for the connection of the mating signal terminals of a mating external electrical connector (not shown).

Referring to FIGS. 10-13, in an alternate form of the present invention, the signal terminals (1,1') of the signal terminal sets (10) each further comprises a second compensation segment (15,15') connected between the connection segment (13,13') and signal input segment (12,12') thereof. The second compensation segment (15,15') of each two adjacent signal terminals (1,1') are reversely curved, forming a compensated structure where the second compensation segments (15,15') are staggered and not in contact with each other. The mating connection block (6) of the electrically insulative terminal block (50) is wrapped about the second compensation segments (15,15').

What the invention claimed is:

1. A modular electrical connector, comprising:

two signal terminal sets vertically arranged adjacent to each other, each said signal terminal set comprising a plurality of signal terminals arranged in parallel, each said signal terminal comprising a signal output segment, an opposing signal input segment, a connection segment connected between said signal output segment and said signal input segment and a first compensation segment connected between said connection segment and said signal output segment, the first compensation segments of the said signal terminals of said two signal terminal sets being reversely curved to form a staggered compensated structure; and an electrically insulative terminal block comprising a mounting block and a mating connection block and being molded on said two signal terminal sets by injection molding, said mounting block being wrapped about the said first compensation segments of the said signal terminals of said two signal terminal sets, said mating connection block being partially wrapped about the said signal input segments and the said connection segments of the said signal terminals of said two signal terminal sets, said mounting block comprising a body and a positioning portion located at one side of said body, said mating connection block comprising a base and a positioning groove located on one side of said base; and wherein the said connection segments of the said signal terminals of said two signal terminal sets are bent to move said mounting block and said mating connection block toward each other to further force said positioning portion of said mounting block into engagement with said positioning groove of said mating connection block.

2. The modular electrical connector as claimed in claim 1, wherein said mounting block further comprises two engagement ribs respectively protruded from two opposite lateral sides of said positioning portion; said mating connection block further comprises two upright stop ribs respectively located at two opposite lateral sides of said positioning groove and respectively engaged with said engagement ribs of said mounting block.

3. The modular electrical connector as claimed in claim 1, wherein said mounting block further comprises a plurality of abutment ribs located at an opposite side of said body remote from said positioning portion, and a bending space defined by said abutment; the said signal output segment of the said signal terminals of said two signal terminal sets are respectively positioned in said bending space and abutted at the respective said abutment ribs.

4. The modular electrical connector as claimed in claim 1, wherein said mating connection block further comprises a staggered abutment surface portion located on an opposite side of said base remote from said positioning groove for abutting against the said signal input segments of the said signal terminals of said two signal terminal sets.

5. The modular electrical connector as claimed in claim 1, wherein each said signal terminal of each said signal terminal set further comprises a second compensation segment connected between the said connection segment and said signal input segment thereof, the said second compensation segments of the said signal terminals of said two signal terminal sets being reversely curved to form a staggered compensated structure; said is wrapped about the said second compensation segments of the said signal terminals of said two signal terminal sets.

6. The modular electrical connector as claimed in claim 1, wherein each said signal terminal set further comprises a first material strip and a second material strip respectively and transversely arranged at two opposite sides in a parallel manner and respectively connected with the respective said signal output segments and the respective said signal input segments of the respective said signal terminals, the said first material strip and said second material strip of one said signal terminal set being respectively stacked on the said first material strip and said second material strip of the other said signal terminal set where the said first compensation segments of the said signal terminals of the two said signal terminal sets exhibit a staggered relationship.

* * * * *